US006263220B1

(12) United States Patent
Mansour

(10) Patent No.: US 6,263,220 B1
(45) **Date of Patent: *Jul. 17, 2001**

(54) NON-ETCHED HIGH POWER HTS CIRCUITS AND METHOD OF CONSTRUCTION THEREOF

(75) Inventor: Raafat R. Mansour, Waterloo (CA)

(73) Assignee: COM DEV Ltd., Cambridge (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/038,697

(22) Filed: Mar. 9, 1998

Related U.S. Application Data

(60) Provisional application No. 60/040,400, filed on Mar. 11, 1997.

(51) Int. Cl.[7] ..... H01P 1/203; H01B 12/02

(52) U.S. Cl. ..... 505/210; 505/700; 505/866; 333/99.005; 333/204; 333/219

(58) Field of Search ..... 333/161, 238, 333/219, 204, 995; 505/210, 700, 701, 866

(56) References Cited

U.S. PATENT DOCUMENTS 5,334,958 * 8/1994 Babbitt et al. ..... 333/161 X
5,479,139 * 12/1995 Koscica et al. ..... 333/161 X
5,703,020 * 12/1997 Das ..... 333/995

* cited by examiner

*Primary Examiner*—Benny T. Lee
(74) *Attorney, Agent, or Firm*—Daryl W. Schnurr

(57) ABSTRACT

A high power superconductive circuit has a thin film of high temperature superconductive material on a substrate. The circuit is formed from wafers that are placed into corresponding grooves within the substrate and held in place by adhesive. The grooves can be blind grooves or they can be through holes and the wafers will have a corresponding size and shape. The wafers include a thin film of high temperature superconductive material and can form resonators or an input or output. A circuit constructed in this manner has a relatively high power handling capability compared to circuits created by etching.

17 Claims, 8 Drawing Sheets

NON-ETCHED HIGH POWER HTS CIRCUITS AND METHOD OF CONSTRUCTION THEREOF

This Appln claims the benefit of Provisional No. 60/040, 400 filed Mar. 11, 1997.

BACKGROUND OF THE INVENTION

1. Field of the Invention

This invention relates to a high power superconductive circuit and to a method of constructing said circuit. More particularly, this invention relates to a circuit having a substrate with one or more grooves formed in said substrate for receiving one or more wafers that are arranged to function as microwave components of said circuit.

2. Description of the Prior Art

It is known to form high temperature superconductive circuits on a substrate using a thin film of ceramic material that becomes superconductive at cryogenic temperatures. Previous circuits are formed by affixing a high temperature superconductive thin film to the substrate and subsequently subjecting the thin film to etching. The etching can be chemical etching or dry etching. When chemical etching is used, the chemical eats away that part of the thin film that must be removed in order to form the desired circuit. A glass plate template is used to cover that portion of the thin film that is not subjected to etching. With dry etching, a milling machine is used to remove those parts of the thin film that must be removed in order to leave the desired circuit on the substrate. Both chemical etching and dry etching require a large time input and both forms of etching degrade the power handling capability of the resulting circuit significantly. The cost of fabricating HTS planar filters is considered extremely high in comparison to that of conventional microwave filters due to the cost of the lithographic process used to fabricate planar high temperature superconductive filters and the limited number of filters one can produce from one high temperature superconductive wafer. The use of lithographic fabrication processes has been known to reduce the power handling capability of high temperature superconductive filters.

SUMMARY OF THE INVENTION

It is an object of the present invention to produce a high power superconductive circuit that has high power handling capability compared to previous circuits and has resonators formed on a substrate without etching and without using lithographic fabrication processes. It is a further object of the present invention to increase the number of HTS circuits that can be produced from one HTS wafer and to produce HTS circuits at a relatively low cost compared to conventional HTS circuits.

A high power high temperature superconductive circuit is used for passing current having a substrate with a base and top. The base has a ground plane thereon and the circuit has an input and output. The top contains at least one groove and at least one corresponding wafer comprising high temperature superconductive material. The groove and wafer are sized and located so that one wafer is located in each groove with each wafer functioning as a microwave component when the current passes through the circuit. Preferably, each circuit has a plurality of grooves and corresponding wafers.

A method of constructing a high power high temperature superconductive circuit having a substrate with a base and a top, the base having a ground plane thereon, said method comprising the steps of forming at least one groove in the top, sizing and locating each groove to receive a corresponding wafer comprising high temperature superconductive material, shaping each wafer to fit within a corresponding groove, placing one wafer in each groove, affixing each wafer with a suitable adhesive, adding an input and an output to the circuit, the wafers being arranged in relation to the input and the output to function as resonators when the circuit is operational.

DESCRIPTION OF A PREFERRED EMBODIMENT

Figure 1:
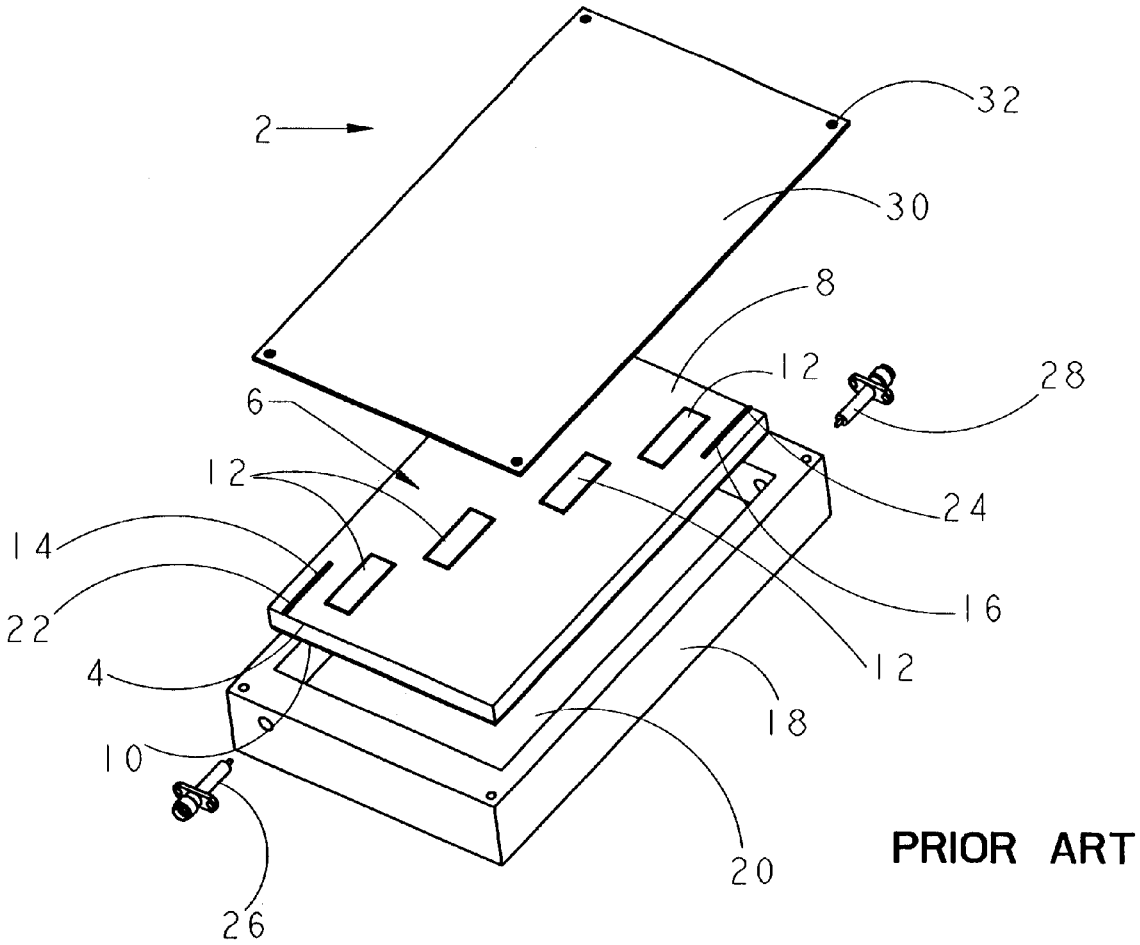
FIG. 1 is an exploded perspective view of a prior art high temperature superconductive planar filter.

In FIG. 1, a prior art microstrip filter 2 has a substrate 4 with a HTS film circuit 6 on a top 8. A complete layer 10 made out of gold is deposited on a back (not shown) of the substrate 4 to serve as a ground plane. The ground plane 10 can be made from any metallized material. The patterned HTS film consists of several resonators 12 and input and output lines 14,16 respectively. The circuit is mounted in a housing 18 by epoxying the ground plane 10 to a bottom 20 of the housing 18. Ohmic contacts 22, 24 are deposited the input/output lines 14, 16 respectively to allow input/output connectors 26, 28 respectively to be attached to the circuit 6 using epoxy, ribbon bonding or other means. A cover 30 has openings 32 for connecting the cover 30 to the housing 18 using screws (not shown). The cover 30 eliminates radiation.

Figure 2:
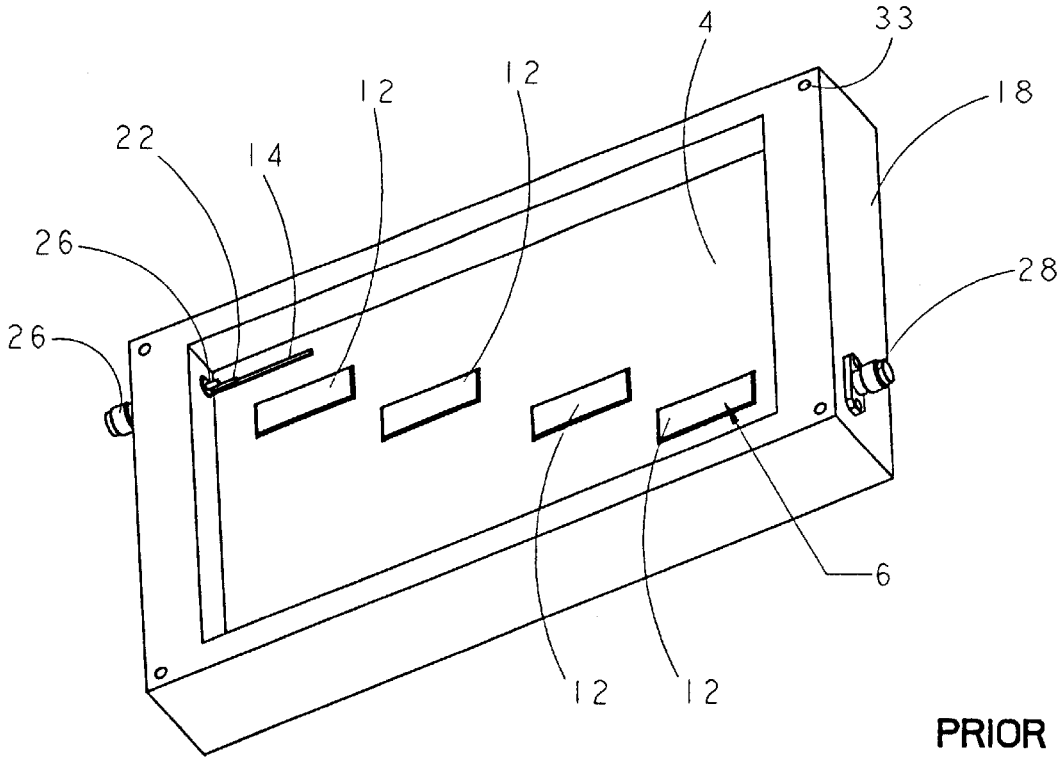
PRIOR ART FIGURE 2
FIG. 2 is a perspective view showing the assembled prior art filter of FIG. 1 with a cover removed.

FIG. 2 illustrates the assembled prior art circuit 6 with the cover 30 (not shown) removed. Those components that are identical to components of FIG. 1 are described in FIG. 2 using the same reference numerals and the components are not all described in detail. The housing 18 has openings 33 for receiving screws (not shown) for attaching the cover (not shown). HTS wafers are available in the form of HTS films deposited on a low-loss dielectric substrate. The most common substrate material in use is Lanthanum Aluminate, which has a dielectric constant of approximately twenty-four. In conventional planar HTS filters, lithographic techniques are used to form a circuit pattern of HTS film on the top of a substrate. In the process, the film on the top 8 of the substrate 4, where no film is shown in FIG. 2, has been etched away from the substrate. The ohmic contacts are formed at a later stage using E-beam deposition or other means.

One problem with the prior art method of fabrication is that, since a large portion of the HTS film is etched away, the construction of a large order filter may require the use of almost an entire HTS wafer. The method of the present invention allows several similar filters to be constructed from one HTS wafer and several gold-film or copper-film wafers. Since the cost of a gold-film wafer or copper-film wafer is much less than that of an HTS wafer, a considerable cost reduction can be achieved with the use of the present invention. Additionally, the proposed method eliminates the need to use any of the etching techniques, thereby saving those costs as well. Further, the power handling capability of the circuit is not degraded with the present invention.

Figure 3A:
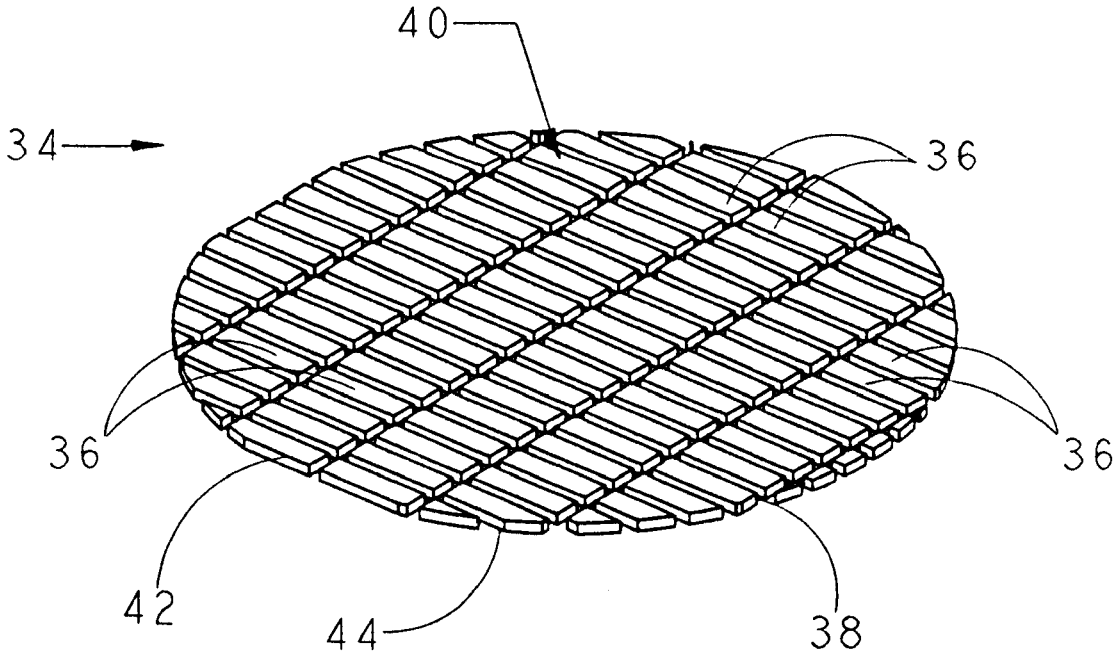
FIG. 3A shows a schematic circular high temperature superconductive wafer diced into several smaller wafers.
Figure 3B:
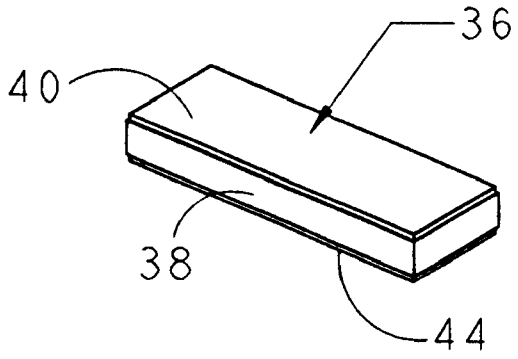
FIG. 3B shows an enlarged rectangular high temperature superconductive wafer after dicing.

FIG. 3A shows a large HTS wafer 34, which has been diced into several small HTS wafers 36. Each wafer 36 consists of a substrate 38 with HTS film 40 on a top 42 and a gold or copper layer 44 on a back (not shown) comprising the ground plane. While the wafer 34 is shown as having a cylindrical shape, it will preferably have a rectangular shape as less waste will occur when dicing smaller rectangular wafers from it. FIG. 3B shows a greatly enlarged rectangular wafer 36 after dicing. The wafer 36 has an HTS film 40 located on a substrate 38. A ground plane 44 extends beneath the substrate 38.

Figure 4:
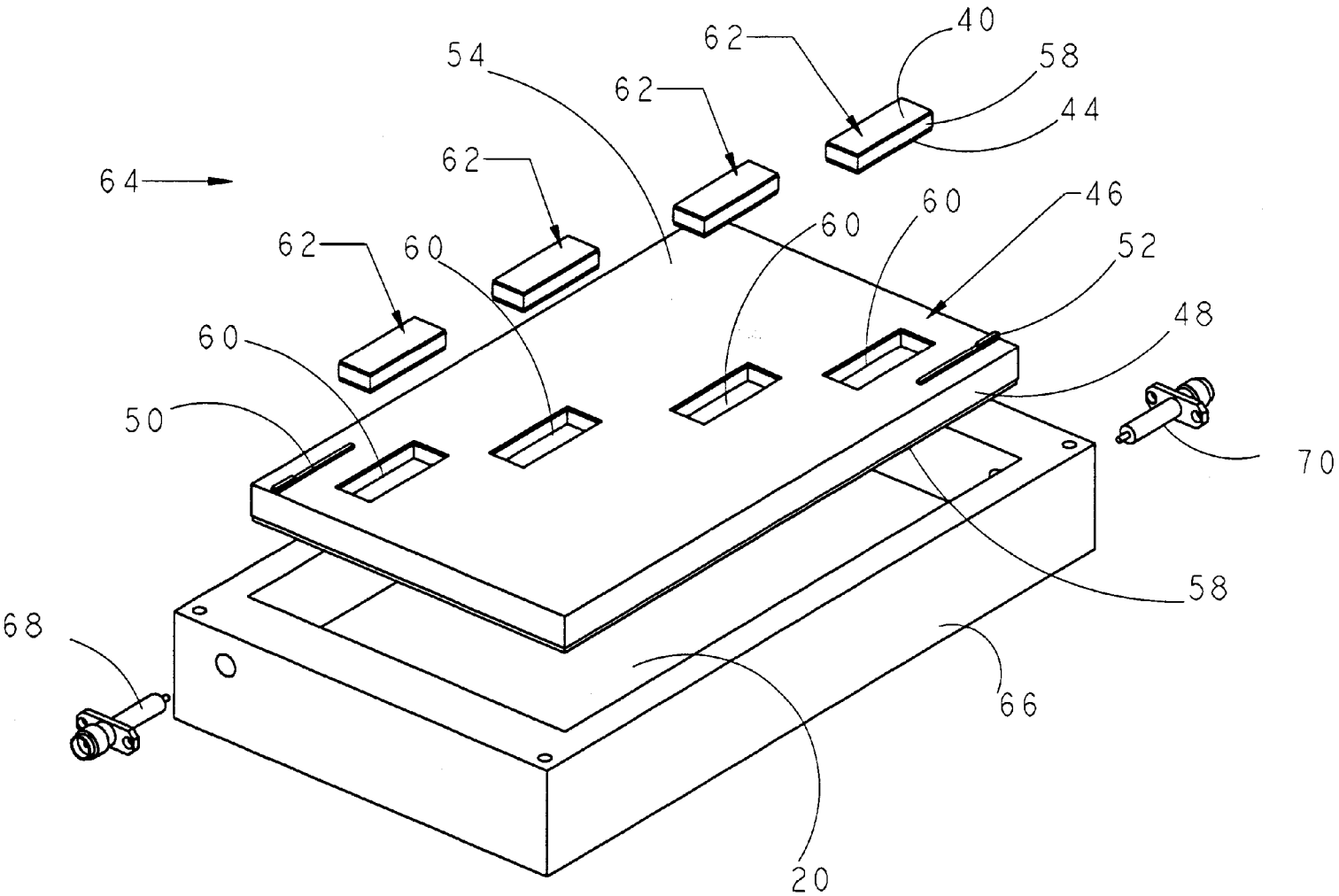
FIG. 4 shows an exploded perspective view of a filter of the present invention with a cover removed.

In FIG. 4, there is shown a circuit 46 according to the present invention, where a substrate 48 has input and output lines 50, 52 made out of gold or copper patterned on a top 54 of the substrate 48. A back (not shown) is coated with a ground plane 58 preferably made from gold or copper film. Several grooves 60 are made in the substrate 48 using laser machining or other means. The grooves have dimensions which are slightly larger than the dimensions of small HTS first wafers 62, which preferably have been cut from a single large wafer, and function as resonators in the circuit 46. Each wafer 62 has an HTS thin film 40 on top of the substrate 38 with a ground plane 44 on the bottom of the substrate. Preferably, the grooves 60 extend through the substrate 48 and the ground plane 44 and are therefore through grooves. There are four first wafers 62 located in the four first grooves 60 respectively making up a filter 64. A cover has been omitted from the drawing. The filter 64 is assembled by attaching the ground plane 58 of the substrate 48 to a bottom 20 of a housing 66 using epoxy or other means. Several small wafers 62 are created by dicing as described in FIG. 3A and individual wafers 62 are then inserted into each of the four first grooves 60. The wafers are attached to the housing by epoxying or other means. Two connectors 68, 70 are connected directly to the input/output lines 50, 52 respectively using epoxy, ribbon bonding or other means. The substrate 48 can be made from any dielectric material having a dielectric constant of substantially twenty-four. With a proper RF design of the circuit, the substrate can be made of any other low-loss dielectric material.

Figure 5:
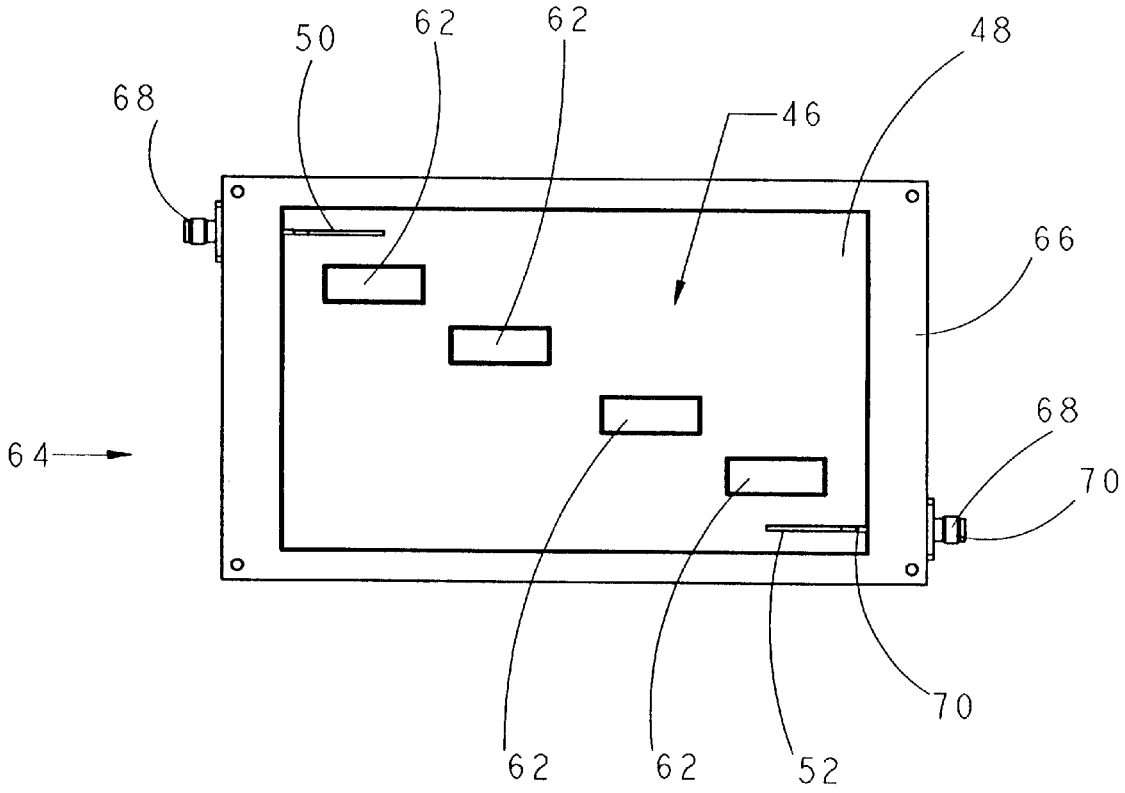
FIG. 5 is a top view of the filter of FIG. 4 as assembled with the cover removed.

FIG. 5 shows a top view of the assembled filter 64 without the cover. Those components of FIG. 5 that are identical to the components of FIG. 4 are described using the same reference numerals and the components are not all described in detail. The use of gold films for the input and output lines 50, 52 has little impact on the quality factor of the HTS resonators formed from the wafers 62. The method of the present invention allows planar filters to be designed using CAD techniques. The effect of the gaps between the HTS films of the wafers 62 and the substrate 48 can be minimized by the use of tuning mechanisms. Another method of minimizing or eliminating the effect of the gap is to fill the gap, after assembly, with dielectric material that has similar characteristics to either the substrate 38 (e.g. see FIG. 3B) of the wafer 62 or the substrate 48 of the filter 64.

Figure 6:
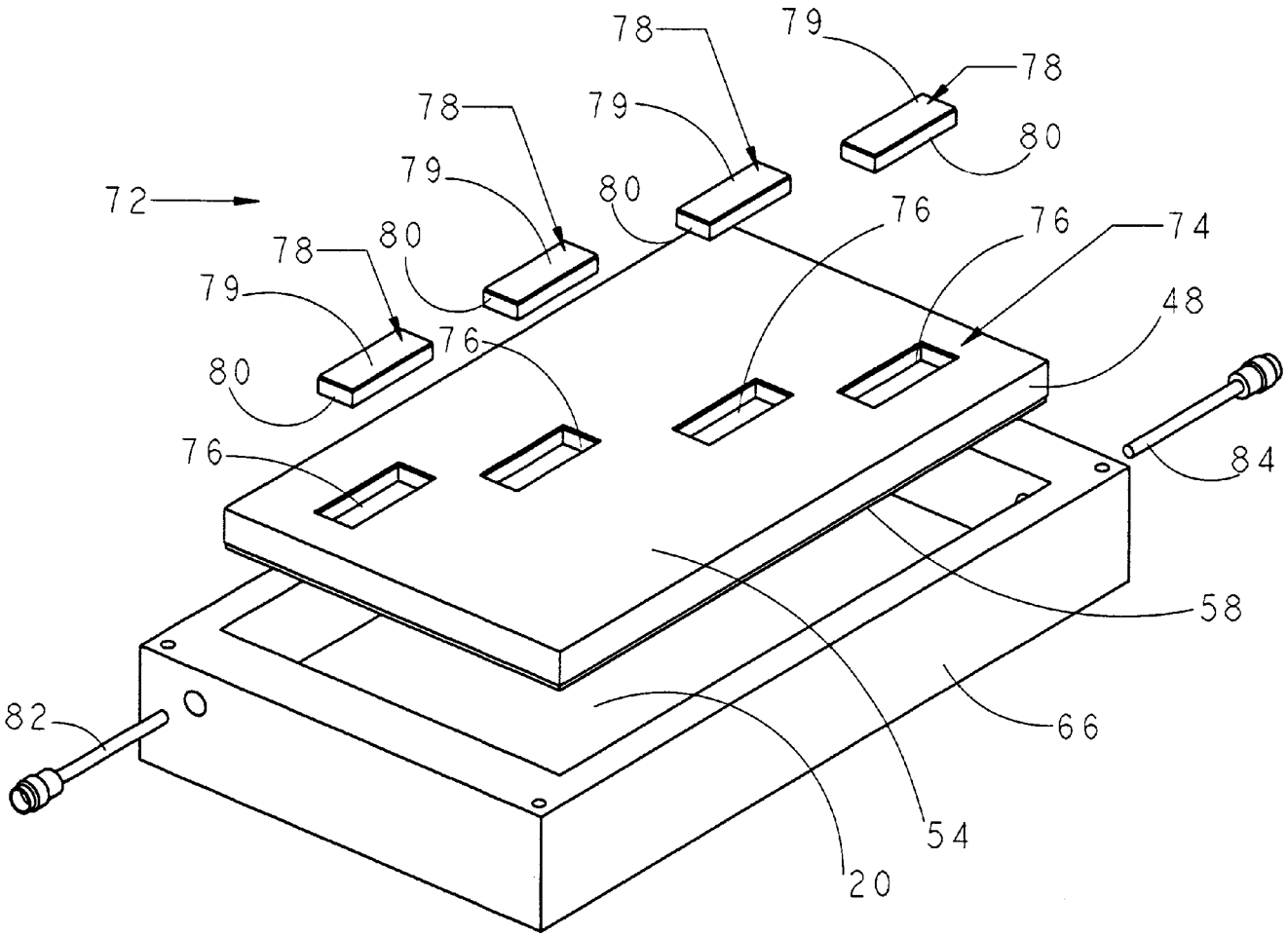
FIG. 6 is an exploded perspective view of a filter representing a further embodiment of the present invention with a cover removed.
Figure 7:
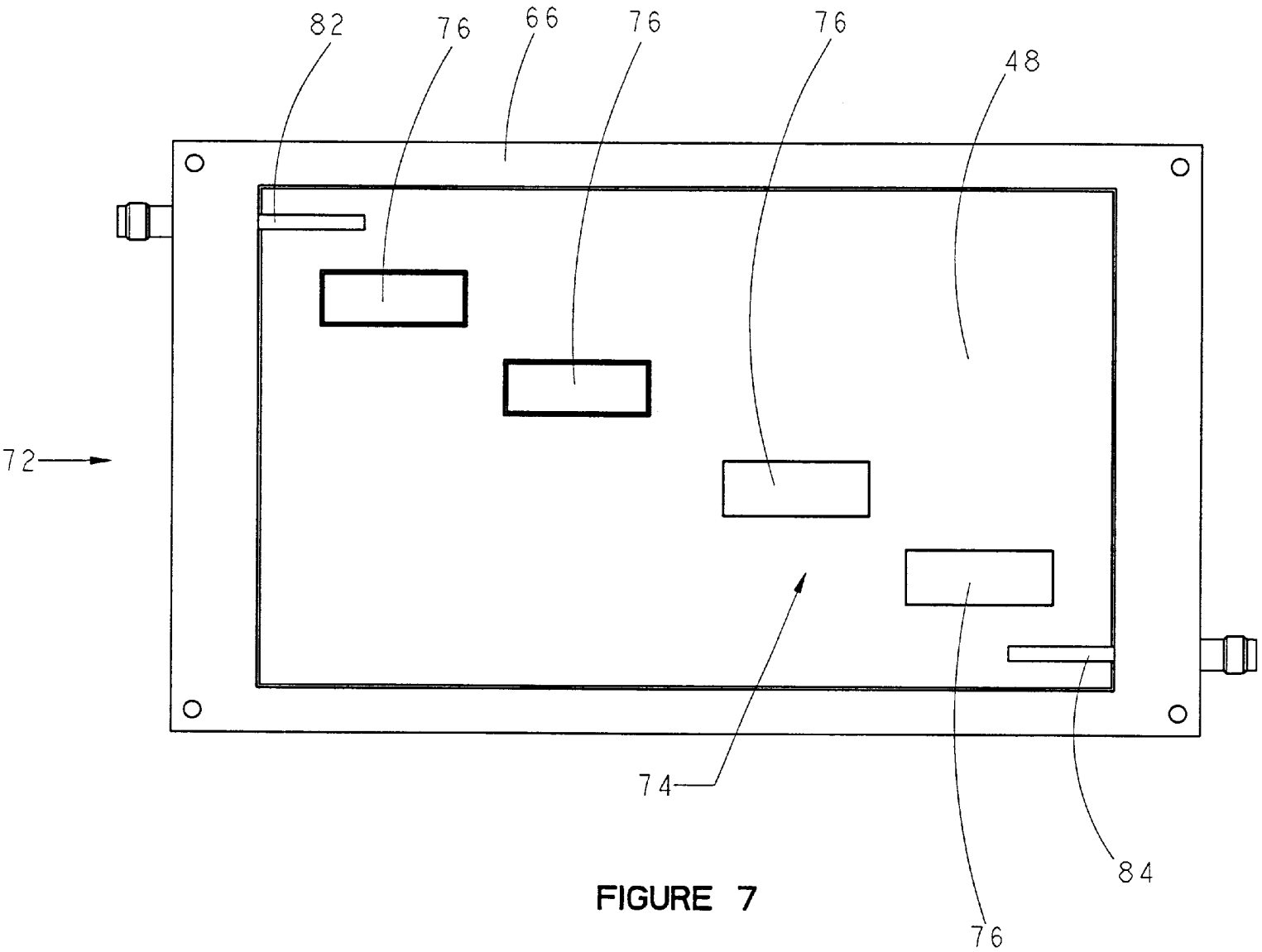
FIG. 7. is a top view of the filter of FIG. 6, as assembled, with the cover removed.

FIG. 6 is an exploded perspective view of a filter 72 having a circuit 74 with a cover omitted. Those components of FIG. 6 that are identical to the components of FIG. 5 are described using the same reference numerals and all of the components are not described in detail. The filter 72 is identical to the filter 64, except for the input/output and the use of blind grooves and the same reference numerals will be used for those components that are identical. The circuit 74 has a substrate 48 and ground plane 58. First blind grooves 76 are made in the substrate 48 by laser machining or other means. The grooves extend only partially into the substrate and do not extend to the ground plane. First wafers 78 have an HTS film 79 on a substrate 80 with no ground plane. The wafers 78 are sized to fit within the grooves 76 with one wafer in each groove. A depth of the substrate 80 for each wafer is chosen so that a top of the substrate 80 will be substantially flush with the top 54 of the substrate 48 after the wafer has been attached within the groove 76 with the HTS thin film 79 on top of the substrate 80 lying above a level of the top 54 of the substrate 48. When blind grooves are utilized, the wafers can be cut from a large wafer that does not have a ground plane and, preferably has a substrate with a thickness equal to that required to properly fill the blind groove in which the wafer is to be inserted. After the substrate 48 has been attached to the housing 66 and the wafers 78 have been affixed into the grooves 76, input and output probes 82, 84 respectively are then inserted into the housing 66. The assembled filter 72 is shown in FIG. 7 without the cover. Those components of FIG. 7 that are identical to the components of FIG. 6 are described using the same reference numerals and the components are not all described in detail. The length of the input/output probes 82, 84 are adjusted during the tuning process to provide the necessary input/output coupling.

Figure 8:
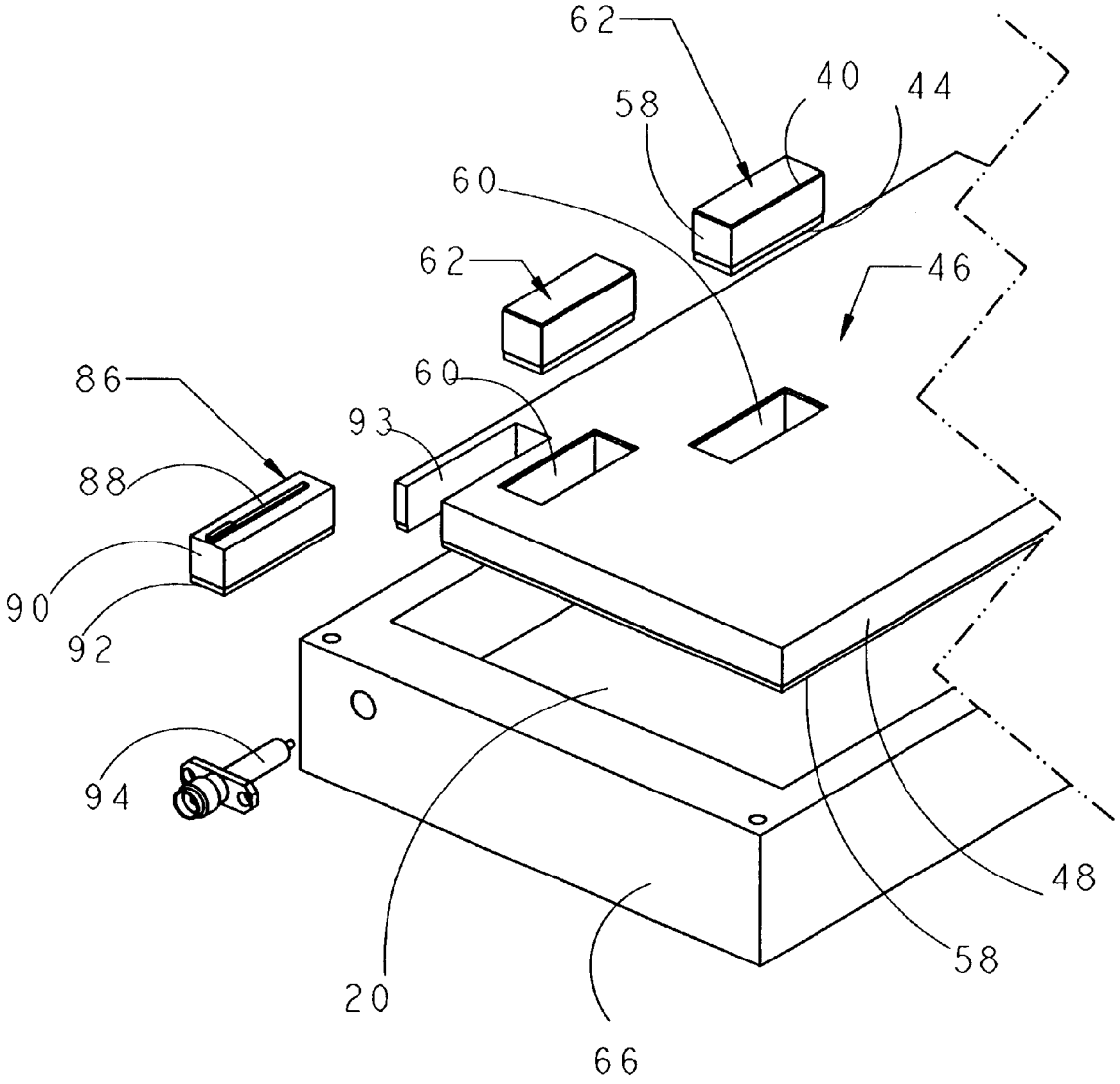
FIG. 8 is a partial exploded perspective view of a filter having an input or output made from a wafer in a groove.

In FIG. 8, those components that are identical to components of FIG. 4 are described using the same reference numerals and which are not all described in detail. The filter is identical to that of FIG. 4 except that a wafer 86 has an input or output line 88 on a substrate 90 with a ground plane 92. The wafer 86 is sized to fit into a U-shaped groove 93. The line 88 is connected to input or output connectors 94. The wafer 86 and corresponding U-shaped groove 93 can be used for one or both of the input and output. The wafer 86 and groove 93 are shown as extending the full depth of the substrate 48 and ground plane 58, but could both be shallower (ie. blind grooves similar in depth to the wafers 78 and grooves 74 of FIG. 6).

In FIG. 4, a substrate can be constructed with a ground plane on a lower surface and a thin metal film on an upper surface thereof. The thin metal film will preferably be formed of gold, silver or copper. The metal film is then etched to remove all of the film except for that part of the film that forms the input and the output of FIG. 4. Grooves are then cut into the substrate and preferably through the ground plane. Wafers are then obtained from a source, such as described in FIG. 3A, and inserted into the grooves cut into the substrate.

While it is preferable to cut the grooves entirely through the substrate and through the ground plane, it is possible to cut the grooves only partially through the substrate and then to size the source of wafers so that a thickness of the substrate beneath the thin film of high temperature superconductive material is substantially equal to the depth of the grooves so that a top surface of the substrate of the wafers is substantially flush with a top surface of the substrate into which the wafers are inserted. The grooves could also be cut through the substrate but stop at the ground plane. Whenever the grooves do not extend through the entire substrate and ground plane, they are referred to as blind grooves. Grooves that cut entirely through the substrate and ground plane are referred to as through grooves. While the filter of FIG. 4 uses through grooves and the filter of FIG. 6 uses blind grooves, the type of groove is interchangeable. Preferably, the high temperature superconductive material is a ceramic material that becomes superconductive at cryogenic temperatures.

I claim:

1. A high power high temperature superconductive circuit for passing current comprising a first substrate having a base and a top, said base having a first ground plane thereon, said circuit having an input and an output, said top containing at least one groove and said circuit comprising at least one corresponding non-etched wafer comprising high temperature superconductive material, said at least one groove and said at least one wafer having a respective size and location so that a respective wafer is located in a corresponding groove with each wafer functioning as a respective microwave component when said current passes through said circuit.

2. A circuit as claimed in claim 1 wherein each wafer comprises a respective thin film of high temperature superconductive material affixed to at least a partial thickness of a corresponding second substrate and each groove has a respective depth to receive the corresponding wafer so that an upper surface of said respective second substrate forming part of said corresponding wafer is substantially flush with an said top of said first substrate immediately adjacent to said wafer when said wafer has been inserted fully into said groove.

3. A circuit as claimed in any one of claims 1 or 2 wherein each groove is a blind groove.

4. A circuit as claimed in claim 2 wherein each groove extends through said first substrate and through the first ground plane beneath said first substrate and each corresponding wafer includes said respective second substrate beneath said corresponding thin film of high temperature superconductive material and a respective second ground plane beneath said corresponding second substrate when the corresponding wafer is in an upright position.

5. A circuit as claimed in any one of claims 1, 2 or 4 wherein the input and output are comprised of wafers respectively comprising high temperature superconductive material located in corresponding grooves of said first substrate.

6. A circuit as claimed in any one of claims 1, 2 or 4 wherein the input and output are comprised of a respective thin film of gold.

7. A circuit as claimed in any one of claims 1, 2 or 4 wherein the input and output are comprised of respective metallized thin films.

8. A circuit as claimed in any one of claims 1, 2 or 4 wherein the respective wafers are resonators.

9. A circuit as claimed in any one of claims 1, 2 or 4 wherein the respective wafers are comprised of a corresponding ceramic material that becomes superconductive at cryogenic temperature.

10. A circuit as claimed in any one of claims 1, 2 or 4 wherein said at least one groove includes at least three grooves and said at least one wafer includes at least three corresponding wafers on said first substrate.

11. A circuit as claimed in any one of claims 1, 2 or 4 wherein said at least one groove comprises a plurality of grooves and said at least one wafer comprises a corresponding plurality of wafers.

12. A circuit as claimed in any one of claims 1, 2 or 4 wherein there is at least one first wafer and at least one corresponding first groove and at least two second wafers and at least two corresponding second grooves, said at least one first wafer in said at least one groove being a resonator of said circuit and said at least two second wafers in said at least two second grooves being of a size which is smaller in size than a size associated with said at least one first wafer and comprising the input and the output of said circuit.

13. A circuit as claimed in claim 1 wherein an adhesive is located to retain said respective wafers in said corresponding grooves and said circuit is located in a housing.

14. A circuit as claimed in claim 13 wherein the adhesive is an epoxy.

15. A method of constructing a high power high temperature superconductive circuit having a first substrate with a base and a top, said base having a first ground plane thereon, said method comprising the steps of forming a plurality of grooves in said top, sizing and locating each groove to receive a corresponding wafer comprising high temperature superconductive material, selecting wafers which have been manufactured by a non-etched process, shaping each wafer to fit within a corresponding groove, placing a respective wafer in a corresponding groove, affixing each wafer to the corresponding groove with a suitable adhesive, adding an input and an output to the circuit either before or after the wafers are placed in said grooves, arranging said wafers in relation to said input and said output to function as resonators when said circuit is operational.

16. A method as claimed in claim 15 including the steps of forming the corresponding wafer so that the respective wafer has a depth of a second substrate beneath the respective wafer, forming each groove to receive the corresponding wafer so that a top of said respective second substrate on the corresponding wafer is substantially flush with a top of said first substrate on said circuit.

17. A method as claimed in claim 15 including the steps of constructing a source of respective wafers by forming a thin film of superconductive material on a second substrate, said second substrate having a second ground plane on a lower surface thereof, dicing said source to create respective wafers of appropriate size, said respective wafers including said thin film of high temperature superconductive material, a layer of the second substrate and a part of the second ground plane on a lower surface of said part of said second substrate, forming a high temperature superconductive circuit on the first substrate having a first ground plane on a lower surface thereof, forming a thin film of gold on an upper surface of said first substrate and etching said thin film of gold to form an input and an output, cutting grooves into said first substrate, said grooves being cut entirely through said first substrate and first ground plane to correspond in size and shape to said respective wafers, inserting one of said respective wafers in each of said grooves respectively, affixing said wafers in said grooves using an adhesive.

* * * * *